US012635794B2

(12) United States Patent
Weidinger et al.

(10) Patent No.: US 12,635,794 B2
(45) Date of Patent: May 26, 2026

(54) DEVICE FOR GUIDING MOVEMENT, SLIDING ELEMENT, AND ITEM OF FURNITURE

(71) Applicant: GRASS GMBH, Höchst (AT)

(72) Inventors: Robert Weidinger, Salzburg (AT); Simon Trebuch, Salzburg (AT)

(73) Assignee: GRASS GMBH, Höchst (AT)

( * ) Notice: Subject to any disclaimer, the term of this patent is extended or adjusted under 35 U.S.C. 154(b) by 0 days.

(21) Appl. No.: 19/190,974

(22) Filed: Apr. 28, 2025

(65) Prior Publication Data

US 2025/0248518 A1 Aug. 7, 2025

Related U.S. Application Data

(63) Continuation of application No. PCT/EP2024/050958, filed on Jan. 17, 2024.

(30) Foreign Application Priority Data

Jan. 27, 2023 (DE) ..... 10 2023 102 072.2

(51) Int. Cl.
*A47B 88/487* (2017.01)
*F24C 15/16* (2006.01)

(52) U.S. Cl.
CPC ..... *A47B 88/487* (2017.01); *F24C 15/168* (2013.01)

(58) Field of Classification Search
CPC ... A47B 88/487; A47B 88/43; A47B 2210/17; A47B 88/427; A47B 88/493; F24C 15/168
See application file for complete search history.

(56) References Cited

U.S. PATENT DOCUMENTS 6,347,849 B1 * 2/2002 Muterthies ..... A47B 88/493 384/19
7,216,646 B2 * 5/2007 Le ..... F24C 15/16 126/339

(Continued)

FOREIGN PATENT DOCUMENTS

CN 105318377 B * 10/2018 ..... F24C 15/168
DE 199 31 842 A1 1/2001

(Continued)

OTHER PUBLICATIONS

German Search Report (Application No. 10 2023 102 072.2) dated Jan. 4, 2024 (7 pages).

(Continued)

*Primary Examiner* — Hanh V Tran
(74) *Attorney, Agent, or Firm* — BURR PATENT LAW, PLLC

(57) ABSTRACT

A device for guiding movement of a sliding element, including a carrier rail fitted on bars, and a pull-out rail displaceable relative to the carrier rail, so that, in the fitted, use state of the device, the sliding element can be supported on a bearing surface of a rail body, extending in the longitudinal direction of the device and belonging to the pull-out rail, and can be moved linearly relative to the bars. The pull-out rail is mounted by rolling-body bearing mechanisms. A rail upper side of the rail body includes an outer side and an inner side, wherein the inner side can be brought into abutment against the rolling-body bearing mechanisms. In the use state of the device, the bearing surface for the sliding element is offset vertically upward in relation to the outer side of the rail upper side of the rail body of the pull-out rail.

10 Claims, 3 Drawing Sheets

(56) References Cited

U.S. PATENT DOCUMENTS

| | | | | |
|---|---|---|---|---|
| 7,448,508 | B2 * | 11/2008 | Babucke | F24C 15/16 211/126.9 |
| 9,587,838 | B2 * | 3/2017 | Stewart | A47B 55/02 |
| 12,171,333 | B2 * | 12/2024 | Heffel | F24C 15/168 |
| 2014/0334751 | A1 * | 11/2014 | Meyer | F24C 15/168 384/22 |
| 2024/0156260 | A1 | 5/2024 | Isele | |

FOREIGN PATENT DOCUMENTS

| | | | | |
|---|---|---|---|---|
| DE | 10338158 | A1 * | 3/2005 | F24C 15/168 |
| DE | 203 21 394 | U1 | 3/2007 | |
| DE | 202008010189 | U1 * | 12/2009 | F24C 15/168 |
| DE | 102006015444 | B4 * | 8/2010 | F24C 15/168 |
| DE | 102009046573 | A1 * | 5/2011 | F24C 15/168 |
| DE | 102010029768 | A1 * | 12/2011 | F24C 15/168 |
| DE | 102012222164 | A1 * | 6/2014 | F24C 15/168 |
| DE | 102014206591 | A1 * | 10/2015 | F24C 15/168 |
| DE | 102015206596 | B3 * | 10/2016 | F24C 15/168 |
| DE | 102015206597 | A1 * | 10/2016 | F24C 15/168 |
| DE | 21 2016 000 133 | U1 | 3/2018 | |
| DE | 102018116219 | A1 * | 1/2020 | F24C 15/168 |
| DE | 20 2019 107 001 | U1 | 4/2021 | |
| EP | 3 323 314 | A1 | 5/2018 | |
| JP | 5286080 | B2 * | 9/2013 | A47B 88/493 |
| WO | 2007/125745 | A1 | 11/2007 | |
| WO | WO-2014053348 | A1 * | 4/2014 | F24C 15/168 |
| WO | 2023/000005 | A1 | 1/2023 | |

OTHER PUBLICATIONS

International Search Report and Written Opinion (Application No. PCT/EP2024/050958) dated Apr. 11, 2024 (13 pages).

International Preliminary Examination Report (with PCT Chapter II Claims) (Application No. PCT/EP2024/050958) dated Dec. 13, 2024 (with English translation) (24 pages).

* cited by examiner

DEVICE FOR GUIDING MOVEMENT, SLIDING ELEMENT, AND ITEM OF FURNITURE

CROSS REFERENCE TO RELATED APPLICATIONS

This application is a continuation of International Application No. PCT/EP2024/050958 filed Jan. 17, 2024, which designated the United States, and claims the benefit under 35 USC § 119(a)-(d) of German Application No. 10 2023 102 072.2 filed Jan. 27, 2023, the entireties of which are incorporated herein by reference.

FIELD OF THE INVENTION

The present invention relates to a device for guiding movement, sliding element, and an item of furniture.

BACKGROUND OF THE INVENTION

In the case of items of furniture such as kitchen or home furnishings, sliding elements such as drawers or shelves are often accommodated in a displaceable manner between horizontally opposite side walls. Kitchen furnishings are also understood to mean, for example, kitchen appliances such as, for example, ovens or refrigerators and the like.

For example, a respective arrangement of bars, for example, a side rack, is present on opposite side walls in the interior of a kitchen appliance or oven, for example, in a muffle of the oven, wherein, in order for the sliding element to be accommodated on both sides, two identical side racks made up of narrow elongate bar portions such as profiles, e.g. bar profiles, are provided opposite one another.

A sliding element, or a plurality of vertically offset sliding elements, can be accommodated on the arrangements of bars, which are located in a fixed position opposite one another in the interior of the oven. By way of opposite lateral portions, the respective sliding element can be supported in a horizontally oriented manner on the two arrangements of bars and can be moved with linearly horizontally sliding action along the arrangements of bars, for example, can be pulled out of the interior of the oven and pushed back into the interior of the oven.

In the case of an oven, the sliding elements are designed, for example, in the form of a baking tray or of a food carrier such as, for example, a supporting rack.

As an alternative, or in addition, a respective device for guiding movement, in each case having a carrier rail and a pull-out rail, can be provided for accommodating a sliding element with the aid of the opposite arrangements of bars. Each device can be arranged on the respective arrangement of bars. The lateral portions of a sliding element can be supported on the two devices, which are present on a common vertical plane. By means of the respectively telescopic devices, the sliding element supported on the device, or on the two devices, can be conveniently and reliably displaced linearly or pulled out and pushed back into the interior of the oven.

The device can be fitted, for example, in a releasable manner on the arrangement of bars. For example, the device is designed in the form of a partial-extension rail mechanism, comprising rolling-body bearing mechanisms for bearing the pull-out rail, wherein the rolling-body bearing mechanisms act between a rail body of the pull-out rail and a bearing portion of the device.

SUMMARY OF THE INVENTION

The object of the present invention is to provide an alternative and/or improved device for guiding movement of a sliding element, in particular, with regard to adapting how the device is fitted onto an existing arrangement of bars on which the device can be fitted.

The present invention proceeds from a device for guiding movement of a sliding element, which can be arranged between opposite side walls of an item of furniture such as a kitchen appliance, wherein the device comprises a carrier rail, which can be fitted on an arrangement of bars on the side wall of the item of furniture, and a pull-out rail, which can be displaced relative to the carrier rail, so that, in the fitted, use state of the device, the sliding element can be supported on a bearing surface of a rail body, extending in the longitudinal direction of the device and belonging to the pull-out rail, and can be moved linearly relative to the arrangement of bars, wherein the pull-out rail is mounted for displacement along a bearing portion of the device by way of rolling-body bearing mechanisms of the device, wherein a rail upper side of the rail body of the pull-out rail comprises an outer side and an inner side, which is located opposite the outer side, wherein the inner side can be brought into abutment against the rolling-body bearing mechanisms, wherein, as seen in respect of the use state of the device, the bearing surface for the sliding element is offset vertically upward in relation to the outer side of the rail upper side of the rail body of the pull-out rail.

For example, in the state in which it is supported on the pull-out rail, the sliding element is coupled for movement to the pull-out rail, e.g. is latched in or latched to the pull-out rail, e.g. on a latching portion of the pull-out rail. For example, the latching portion projects from the bearing surface, for example, in the form of a pin portion, which projects for example, vertically upward on the bearing surface, for example, in a front end portion of the pull-out rail. The latching portion is, for example, specifically configured so that, in the use state of the device, it fits in an opening or depression on the sliding element. When the sliding element supported or positioned on the bearing surface is pulled, for example, forward by a user, the pull-out rail is carried along in the forward direction, in each case on the two devices provided on the respective arrangement of bars on each side wall, relative to the carrier rail, which is respectively fixed in position, e.g. latched, on the relevant arrangement of bars.

The device can be fitted, for example, in a releasable manner on the arrangement of bars, for example, it can be fitted in a releasable manner thereon, and removed again, without the use of tools and/or manually. For example, the device is designed in the form of a partial-extension mechanism or in the form of a partial-extension rail mechanism, comprising rolling-body bearing mechanisms for bearing the pull-out rail relative to the carrier rail, wherein the rolling-body bearing mechanisms act between the rail body of the pull-out rail and the bearing portion of the device. For example, the bearing portion of the device is an upper side of the carrier rail. For example, as an alternative, the device is designed in the form of a full-extension mechanism having a carrier rail, a central rail and a pull-out rail.

For example, the rolling-body bearing mechanisms comprise a plurality of individual rolling bodies, for example, spherical or roller-type rolling bodies, which are accommodated in a defined position in relation to one another in a cage.

The core of the present invention resides in the fact that the bearing surface for supporting the sliding element is present on a crosspiece portion, which is formed in one piece with the rail body of the pull-out rail. For example, the rail body and the crosspiece portion are in the form of a single-piece bent sheet-metal part. Production of the device is therefore advantageous in relation to production of the device in which two components are produced and then connected. Up until now, for example, the bearing surface is formed on a component which has to be produced in addition, and then, in a further, separate production step, this component is connected, for example, cohesively bonded, e.g. welded, to the rail body in order for the device to be completed, which involves high outlay and/or is disadvantageous.

For example, the crosspiece portion is specifically configured such that, in the use state of the device, that is to say when the device has been fitted on the arrangement of bars, the bearing surface is spaced apart vertically upward to some extent in relation to a horizontally extending bar portion nearest to the bearing surface, such as a bar of the arrangement of bars, or is spaced apart upward to some extent in relation to an upper side of the bar portion. For example, the crosspiece portion is specifically configured such that, in the use state of the device, the bearing surface is spaced apart vertically upward to some extent in relation to an upper side of the nearest horizontal bar portion of the arrangement of bars. For example, the distance between the bearing surface and the upper side of the horizontal bar portion of the arrangement of bars is in the millimeter range, for example, this distance is between 1 and 5 millimeters.

For example, the relevant bar portion or bar of the arrangement of bars is a lower bar portion of two parallel bar portions which are present in pairs on the arrangement of bars and, in a vertically spaced-apart state, delimit an insertion gap. For example, in an arrangement of bars without the device fitted, the insertion gap serves for the insertion, support and guidance of a sliding element. The two paired bar portions of the arrangement of bars are spaced apart by a vertical distance which makes it possible for a lateral portion of the sliding element to be positioned with play therebetween in order for the sliding element to be supported on the lower of the two bar portions when there is no device fitted on the arrangement of bars. The underside of the sliding element then slides on the upper side of the lower bar portion when the sliding element is being pulled out and pushed in. So that, when the device has been fitted, the underside of the lateral portion of the sliding element resting on the bearing surface does not simultaneously have a sub-portion brushing past the upper side of the lower horizontal bar portion of the arrangement of bars, the bearing surface is specifically configured so as to be present in spatial terms some way above the upper side of the lower horizontal bar of the arrangement of bars. Otherwise, the bar portion and a part of the lateral portion of the sliding element that extends laterally over the bearing surface could or would make contact, and this would give rise to scraping noises when the sliding element, supported on the device, is displaced and/or would result in a braking effect as a result of friction between the underside of the sliding element and the upper side of the lower horizontal bar portion.

For example, the rail body is designed in the form of a bent sheet-metal part. For example, the crosspiece portion adjoins a remaining part of the rail body in one piece by way of a bent-over section. For example, the bent-over section is at right angles between the rail upper side and the crosspiece portion.

For example, the crosspiece portion projects upward or vertically in relation to the rail upper side of the rail body. For example, the crosspiece portion has a main portion, e.g. from a bent-over section to the bearing surface. For example, the bearing surface is a narrow upper side of the crosspiece portion, for example, a location which is at the vertically highest point in the use state of the device. For example, the bearing surface is in the form of a bent-over section of a portion of the material of the pull-out rail or in the form of a sub-region of the bent-over section. For example, the bearing surface is in the form of a bent-over section which adjoins the upwardly extending main portion in one piece. For example, the bent-over section is formed in the downward direction through 180 degrees. For example, the bearing surface is of slightly outwardly convex shape.

For example, the main portion of the crosspiece portion, e.g. one or two vertical material layers, bridges a vertical distance between the rail upper side of the rail body and the bearing surface. The bearing surface and the lateral portion of the sliding element are specifically configured in relation to one another such that, in the supported state, mutual abutment at a point, along a line or over a surface area can be achieved.

For example, the bearing surface serves for in-contact support of part of the sliding element, for example, of an underside of a lateral portion of the sliding element.

Accordingly, the bearing surface serves for supporting the underside of the sliding element on the bearing surface.

For example, the crosspiece portion extends over the entire length or over a significant length, for example, 80 to 95 percent of the length, of the pull-out rail.

For example, the bearing surface is formed over the entire length or over part of the length of the crosspiece portion.

For example, the bearing surface is formed, for example, in a longitudinally narrow and continuous state on the crosspiece portion. For example, a width of the bearing surface, as seen transversely in relation to the longitudinal extent of the crosspiece portion and/or transversely in relation to the bearing surface, is in the range of a single thickness or double the thickness of the material of the crosspiece portion, for example, in relation to a thickness of the associated sheet-metal material.

For example, the rail body, together with the crosspiece portion, is configured in the form of a bent sheet-metal strip or in the form of a bent sheet-metal profile.

For example, the crosspiece portion, which is formed in one piece with the rail body, is connected to the rail upper side of the rail body of the pull-out rail by way of a bent-over section.

For example, the crosspiece portion adjoins a remaining part of the rail body by way of a bent-over section. For example, the bent-over section is at right angles. For example, in the use state of the device, the crosspiece portion is oriented vertically. For example, in the use state of the device, the rail upper side of the rail body of the pull-out rail is oriented horizontally.

For example, the bent-over section between the crosspiece portion and rail upper side runs along a longitudinal extent of the upper side, for example, along a longitudinal edge of the upper side of the rail body.

For example, the crosspiece portion is formed over the length of the rail body. For example, the crosspiece portion is designed in a wall-like manner and/or in the form of a thin sheet-metal strip. For example, a longitudinal extent of the crosspiece portion or a longitudinal axis of the crosspiece portion is parallel to the longitudinal axis of the pull-out rail, e.g. parallel to the longitudinal axis of the rail body of the pull-out rail.

For example, the crosspiece portion extends over most of the length or over the entire length of the rail body and/or of the rail upper side. The sliding element can thereby be advantageously supported on the crosspiece portion. For example, the sliding element can be supported on the crosspiece portion, and therefore on the pull-out rail, along a line and/or along a strip and/or at a point, e.g. by way of a plurality of supporting regions.

For example, the bearing surface is part of the crosspiece portion. For example, the bearing surface is formed by a vertically upper end of the crosspiece portion, as seen in the use state of the device.

For example, the bearing surface is an integral constituent part of a bent-over section of a material portion of the crosspiece portion. For example, in the use state of the device, the bent-over section is formed at an upper end of the crosspiece portion.

For example, as an alternative, the bearing surface is separate from the crosspiece portion, for example, fitted in the form of a separate element on the crosspiece portion or formed in one piece on the crosspiece portion.

For example, the crosspiece portion comprises two adjacent material layers. For example, as seen in respect of the use state of the device, the crosspiece portion comprises an upwardly directed sheet-metal portion, which extends as far as a bent-over section. From the bent-over section, an adjoining downwardly directed sheet-metal portion extends to a height which correlates, e.g. coincides, with the rail upper side of the rail body of the pull-out rail. For example, one side of the upwardly directed sheet-metal portion butts against one side of the downwardly directed sheet-metal portion. This gives a mechanically comparatively stable crosspiece portion, for example, in the manner of a two-walled or two-layered crosspiece portion.

For example, the upwardly directed sheet-metal portion and the downwardly directed sheet-metal portion form two material layers which butt against one another over their surface areas and are oriented, for example, parallel to one another and/or, in the use state, vertically.

For example, the bearing surface is formed by an upper edge of the crosspiece portion. For example, the bearing surface is formed by a blunt end or by a shaped, e.g. bent, upper end of the crosspiece portion or is appropriately fitted in a blunt or bent-over state on the crosspiece portion.

For example, an upper edge of the crosspiece portion is formed by a bent-over section of the material of the crosspiece portion. For example, the upper edge of the crosspiece portion is bent over and forms the bearing surface.

For example, as seen in a width direction of the device, the crosspiece portion comprises an interior material layer and an exterior material layer.

For example, the two material layers are connected to one another over their surface areas and/or at associated longitudinal ends, e.g. by way of a bent-over material section, for example, by way of a bending angle of 180 degrees.

For example, the exterior material layer extends downward to a region of an underside of the device.

For example, holding mechanisms for releasably anchoring the device on the arrangement of bars are present. For example, the holding mechanisms comprise latching mechanisms for latchably anchoring the device on the arrangement of bars, for example, on a vertical bar portion and/or horizontal bar portion of the arrangement of bars.

For example, the holding mechanisms are present on the carrier rail, e.g. are present in one piece on the carrier rail.

For example, the holding mechanisms are designed to engage around a vertical and/or horizontal bar portion of the arrangement of bars. For example, the holding mechanisms are of resilient design. Automatic anchoring can be established as a result. For example, the holding mechanisms can be positioned on a bar portion of the arrangement of bars such that it engages around the same. For example, the holding mechanisms are designed such that, in the use state of the device, when the latter has been anchored on the arrangement of bars, it is not possible for the carrier rail to move in two opposite directions, for example, as seen in respect of a horizontal and/or vertical direction in space.

The present invention relates to a sliding element which can be arranged in a movable manner between opposite side walls of an item of furniture such as a kitchen appliance, in particular, a food carrier for an oven, having a device according to one of the above-described embodiments. A system made up of a sliding element, such as, for example, a food carrier, a rack, a baking sheet or a shelf, along with a device for guiding movement, such as a partial-extension rail mechanism, is thereby provided. For example, the system comprises a sliding element and two appropriate devices for guiding movement.

Finally, the present invention proposes an item of furniture, in particular, a kitchen appliance, having opposite side walls and a respective arrangement of bars on the side wall, wherein a device for guiding movement according to one of the configurations discussed above is provided. For example, the item of furniture is a kitchen appliance such as an oven having a muffle, which, on opposite side walls, has a respective arrangement of bars with a respective device for guiding movement.

BRIEF DESCRIPTION OF THE DRAWINGS

Further features and advantages of the present invention will be explained in more detail with reference to exemplary embodiments.

DETAILED DESCRIPTION OF THE INVENTION

Figure 1:
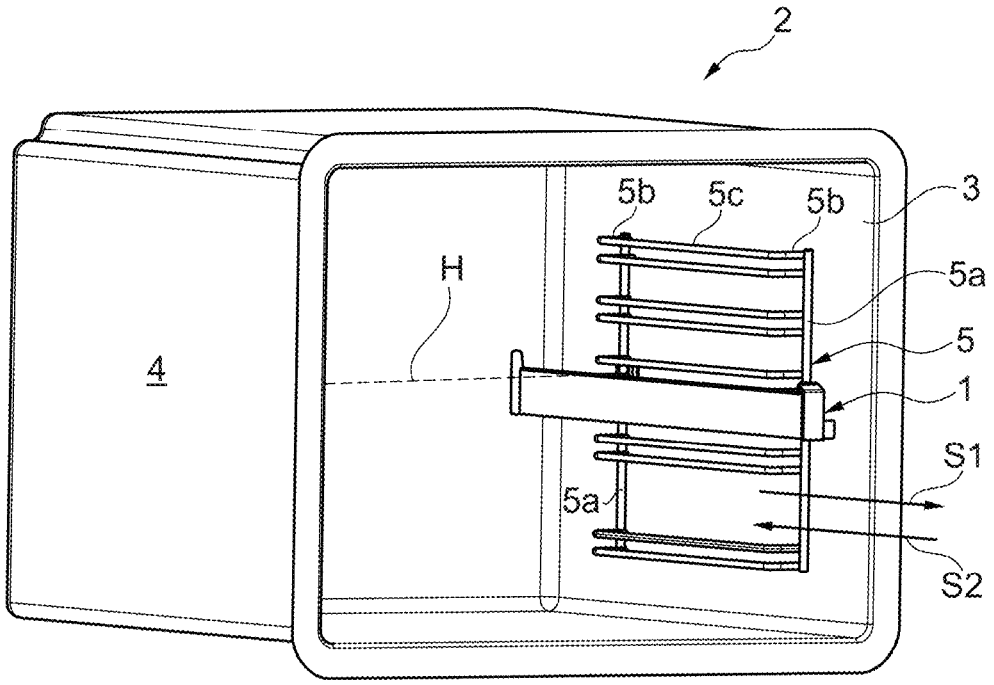
FIG. 1 shows a perspective view, as seen obliquely from the front, of an interior component of a kitchen appliance having arrangements of bars and a device for guiding movement.
Figure 2:
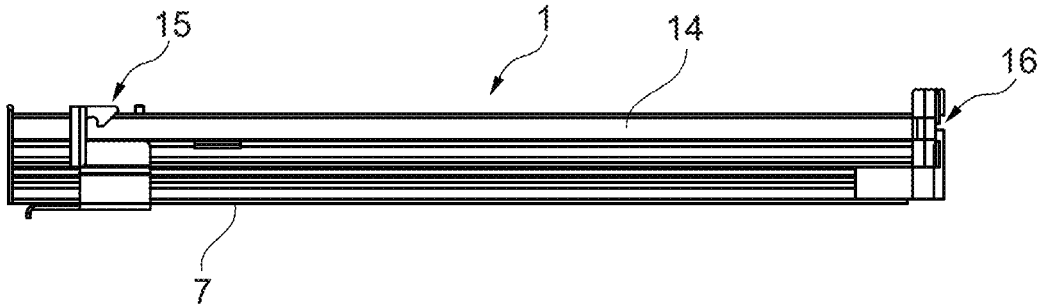
FIG. 2 shows a device for guiding movement of a sliding element, as seen from a first side.
Figure 3:
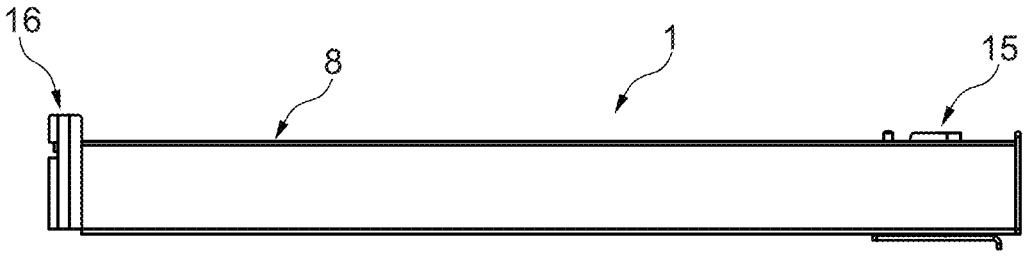
FIG. 3 shows the device according to FIG. 2, as seen from a second side.
Figure 4:
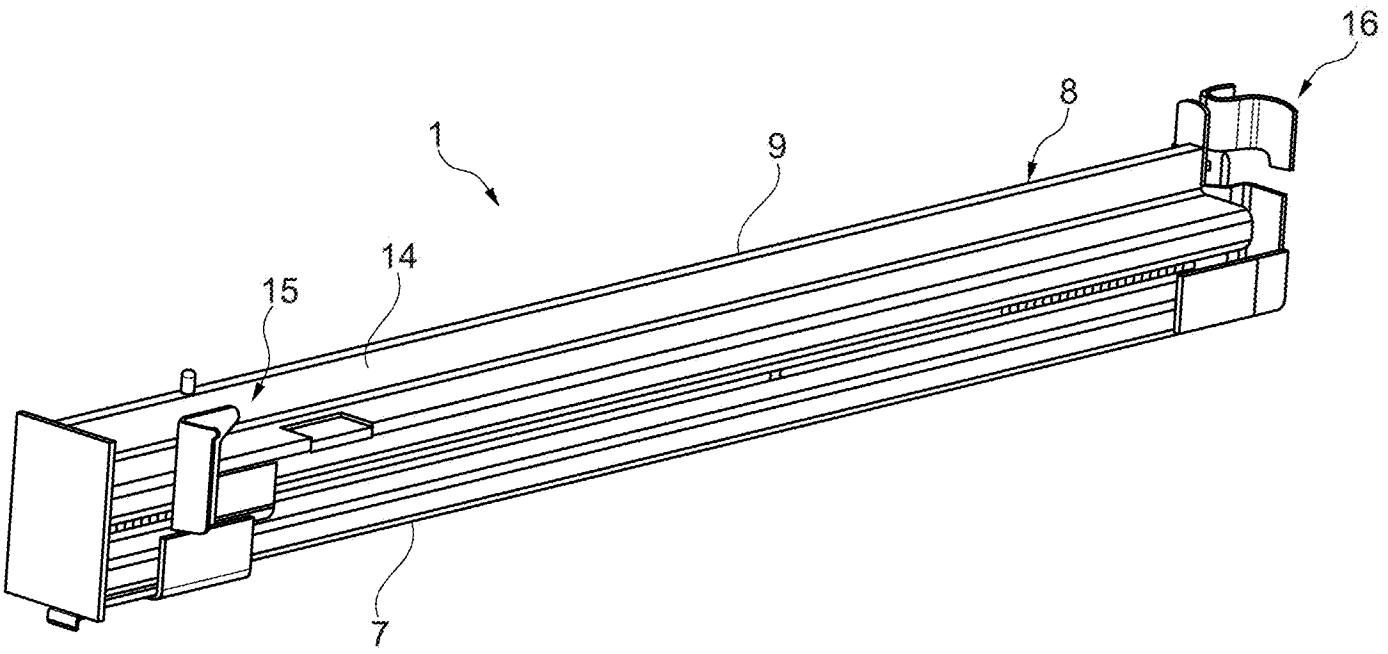
FIG. 4 shows a perspective view of the device according to FIG. 2.

FIG. 1 shows an open-front interior part 2 of an item of furniture in a use-compatible orientation, wherein the item of furniture is designed in the form of a kitchen appliance such as an oven and the interior part 2 belongs to a muffle of the oven. The interior part 2 encloses the muffle of the oven at the rear, bottom, top and sides, by way of opposite side walls 3 and 4 of the muffle. A front side of the interior part 2 is open and, during operation of the oven, can be closed to the outside by an oven door (not illustrated).

Figure 6:
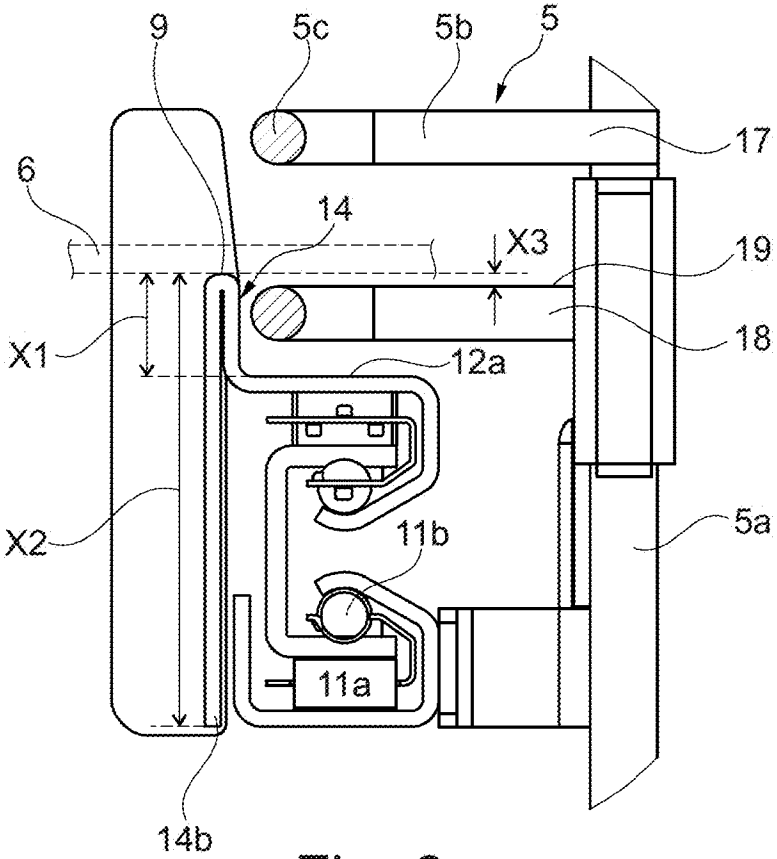
FIG. 6 shows an end view from the front of a device for guiding movement of a sliding element, the device having been fitted on an arrangement of bars, but parts of the device having been omitted.

Within the muffle, or in the interior thereof, a respective identical-construction arrangement of bars 5, such as, for example, a side rack, is fitted on the two side walls 3, 4. The arrangement of bars 5 can only be seen on the side wall 3 in FIG. 1. A device 1 for guiding movement of a sliding element 6 (see FIG. 6) is arranged on the arrangement of bars 5. The underside of the sliding element 6, for example, a food carrier of the oven, can be supported, by way of lateral longitudinal portions of the sliding element 6, on a bearing surface 9 of the device. The two opposite longitudinal portions of the sliding element 6 here can be supported in the same way on the respective device 1 on the respective arrangement of bars 5 on the side walls 3 and 4, at the same horizontal height H of the muffle (see FIG. 1).

By way of example, the device 1 for guiding movement of the sliding element 6 is designed in the form of a full-extension mechanism and has a carrier rail 7 and a pull-out rail 8, which can be displaced relative to the carrier rail 7. A central rail 7*a* is present between the carrier rail 7 and the pull-out rail 8.

In the use state of the device 1, when the latter has been fitted on the arrangement of bars 5, the sliding element 6 is supported on the bearing surface 9 of a rail body 10, extending in the longitudinal direction of the device 1 and belonging to the pull-out rail 8. The sliding element 6 here is coupled to the pull-out rail 8 (see FIG. 6), for example, is latched in a latching portion of the pull-out rail 8, and, together with the pull-out rail 8, can be moved linearly relative to the arrangement of bars 5 and the carrier rail 7 fixed thereon, by way of the central rail 7*a*, in a pulling-out direction S1 and in a pushing-in direction S2 (see FIG. 1).

The pull-out rail 8 is mounted for displacement along a bearing portion of the device or of the central rail 7*a* by way of rolling-body bearing mechanisms 11 of the device 1. A rail upper side 12 of the rail body 10 of the pull-out rail 8 comprises an outer side 12*a* and an inner side 12*b*, which is located opposite the outer side 12*a*. The inner side 12*b* can be brought into abutment against the rolling-body bearing mechanisms 11.

For example, the rolling-body bearing mechanisms 11 comprise roller-form bearing bodies 11*a* and spherical bearing bodies 11*b*, which are held, for example, in a common bearing cage 13. For example, the rolling-body bearing mechanisms 11 comprise upper rolling-body bearing mechanism and lower rolling-body bearing mechanism. For example, the rolling-body bearing mechanisms 11 act on an upper portion of the device 1 between the pull-out rail 8 and the, for example, U-shaped central rail 7*a*. The rolling-body bearing mechanisms 11 also act on a lower portion of the device 1 between the central rail 7*a* and the carrier rail 7.

Figure 5:
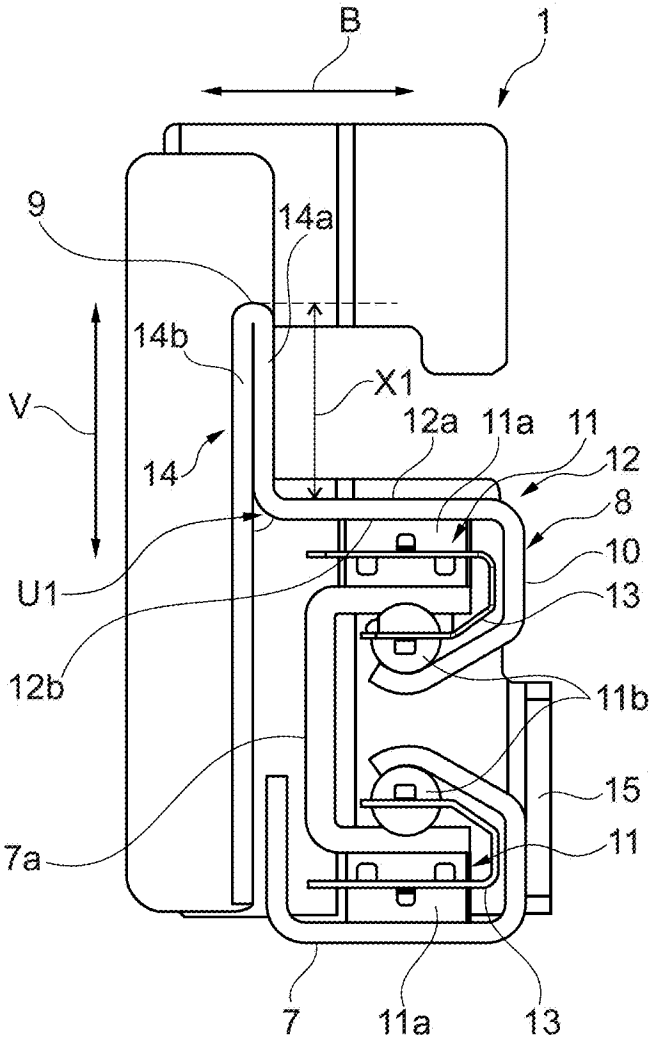
FIG. 5 shows an end view from the front of the device according to FIG. 2, part of the device having been omitted.

As seen in respect of the use state of the device, the bearing surface 9 for the sliding element 6 is offset upward in a vertical direction V by a height or by a height dimension X1 (see FIGS. 5 and 6), as seen in respect of the use state of the device 1, in relation to the outer side 12*a* of the rail upper side 12 of the rail body 10 of the pull-out rail 8.

The bearing surface 9 is present on a crosspiece portion 14, which is formed in one piece with the rail body 10 of the pull-out rail 8. For example, the bearing surface 9 is formed by a vertically upper edge of the crosspiece portion 14. For example, the bearing surface 9 is part of the crosspiece portion 14.

The crosspiece portion 14 is connected to the rail upper side 12 of the rail body 10 by way of a bent-over section U1.

For example, as seen in a width direction B of the device 1, the crosspiece portion 14 has two adjacent material layers, comprising an interior material layer 14*a* and an exterior material layer 14*b*.

For example, the exterior material layer 14*b* extends downward from the bearing surface 9 to a region of an underside of the device 1. For example, a vertical height dimension X2 of the exterior material layer 14*b* is variable, for example, extending to an underside of a bottom part of the pull-out rail 8 or terminating some way further up. For example, the vertical height dimension X2 of the exterior material layer 14*b* corresponds at least approximately to an overall height of the device 1.

A height dimension X3 is or can be specified in variable terms, depending on the manufacturing specifications of the device 1. For example, the height dimension X3 defines a vertical distance of the bearing surface 9 from an upper side 19 of a lower bar portion 18. The lower bar portion 18 is of the same kind as a parallel bar portion 17 above, an insertion gap being delimited between the two parallel bar portions 17, 18, which are spaced apart vertically in pairs on the arrangement of bars 5. For example, in an arrangement of bars 5 without the device 1 fitted, the insertion gap serves for the insertion, support and guidance of a sliding element 6.

For example, there are holding mechanisms 15, 16 provided for the device 1, and these serve for releasably anchoring the device 1 on the arrangement of bars 5. The holding mechanisms 15, 16 are specifically configured for anchoring, for example, on a vertical bar portion 5*a* and/or on a horizontal bar portion 5*b* and/or a further horizontal bar portion 5*c* of the arrangement of bars 5. For example, the holding mechanisms 15, 16 comprise latching mechanisms for latchably anchoring the device 1 on the arrangement of bars 5, for example, on the vertical bar portion 5*a* and/or the horizontal bar portions 5*b*, 5*c* of the arrangement of bars 5.

For example, the holding mechanism 15 is designed in the form of front holding mechanism 15. For example, the holding mechanism 16 is designed in the form of rear holding mechanism 16.

LIST OF REFERENCE SIGNS

1 device
2 interior part
3 side wall
4 side wall
5 arrangement of bars
5*a*-5*c* bar portion
6 sliding element
7 carrier rail
7*a* central rail
8 pull-out rail
9 bearing surface
10 rail body
11 rolling-body bearing mechanism
11*a* bearing body
11*b* bearing body
12 rail upper side
12*a* outer side
12*b* inner side
13 bearing cage
14 crosspiece portion
14*a* material layer
14*b* material layer
15 holding mechanism
16 holding mechanism
17 bar portion

18 bar portion

19 upper side

The invention claimed is:

1. A device having an arrangement of bars, on which the device can be fitted, wherein the device is provided for guiding movement of a sliding element, which can be arranged between opposite side walls of an item of furniture, wherein the device comprises a carrier rail, which can be fitted on the arrangement of bars on the side wall of the item of furniture, and a pull-out rail, which can be displaced relative to the carrier rail, so that, in the fitted, use state of the device, the sliding element can be supported on a bearing surface of a rail body, extending in the longitudinal direction of the device and belonging to the pull-out rail, and can be moved linearly relative to the arrangement of bars, wherein the pull-out rail is mounted for displacement along a bearing portion of the device by way of rolling-body bearing mechanisms of the device, wherein a rail upper side of the rail body of the pull-out rail comprises an outer side and an inner side, which is located opposite the outer side, wherein the inner side can be brought into abutment against the rolling-body bearing mechanisms, wherein, as seen in respect of the use state of the device, the bearing surface for the sliding element is offset vertically upward in relation to the outer side of the rail upper side of the rail body of the pull-out rail, wherein the bearing surface for supporting the sliding element is present on a crosspiece portion, which is formed in one piece with the rail body of the pull-out rail, wherein the arrangement of bars comprises a vertical bar portion and a horizontal bar portion, wherein holding mechanisms for releasably anchoring the device on the arrangement of bars are present, wherein the crosspiece portion is specifically configured such that, in the use state of the device, the bearing surface is spaced apart vertically upward to some extent in relation to an upper side of the nearest horizontal bar portion of the arrangement of bars, wherein the distance between the bearing surface and the upper side of the horizontal bar portion of the arrangement of bars is between 1 and 5 millimeters, and wherein the crosspiece portion is formed over the length of the rail body, wherein the rolling-body bearing mechanisms comprise roller-form bearing bodies and spherical bearing bodies held within a common bearing cage, and wherein the rail body and the crosspiece portion are in the form of a single piece bent sheet metal part.

2. The device having an arrangement of bars as claimed in claim 1, wherein the crosspiece portion, which is formed in one piece with the rail body, is connected to the rail upper side of the rail body of the pull-out rail by way of a bent-over section.

3. The device having an arrangement of bars as claimed in claim 1, wherein the bearing surface is part of the crosspiece portion.

4. The device having an arrangement of bars as claimed in claim 1, wherein the crosspiece portion comprises two adjacent material layers.

5. The device having an arrangement of bars as claimed in claim 1, wherein the bearing surface is formed by an upper edge of the crosspiece portion.

6. The device having an arrangement of bars as claimed in claim 1, wherein an upper edge of the crosspiece portion is formed by a bent-over section of the material of the crosspiece portion.

7. The device having an arrangement of bars as claimed in claim 1, wherein as seen in a width direction of the device, the crosspiece portion comprises an interior material layer and an exterior material layer.

8. The device having an arrangement of bars as claimed in claim 7, wherein the exterior material layer extends downward to a region of an underside of the device.

9. A sliding element which can be arranged in a movable manner between opposite side walls of an item of furniture having a device having an arrangement of bars as claimed in claim 1.

10. An item of furniture, in particular a kitchen appliance, having opposite side walls, wherein a device having an arrangement of bars as claimed in claim 1 is present and wherein a respective arrangement of bars is present on the side wall.

* * * * *